US011677186B2

(12) United States Patent
Bianchin

(10) Patent No.: US 11,677,186 B2
(45) Date of Patent: Jun. 13, 2023

(54) QUICK ASSEMBLY PLUG CONNECTOR

(71) Applicant: Littelfuse, Inc., Chicago, IL (US)

(72) Inventor: Tiziano Bianchin, Verona (IT)

(73) Assignee: Littelfuse, Inc., Chicago, IL (US)

( * ) Notice: Subject to any disclaimer, the term of this patent is extended or adjusted under 35 U.S.C. 154(b) by 23 days.

(21) Appl. No.: 17/404,196

(22) Filed: Aug. 17, 2021

(65) Prior Publication Data

US 2023/0056598 A1 Feb. 23, 2023

(51) Int. Cl.

| | |
|---|---|
| ***H01R 13/639*** | (2006.01) |
| ***H01R 13/506*** | (2006.01) |
| ***H01R 13/52*** | (2006.01) |
| ***H01R 13/629*** | (2006.01) |

(52) U.S. Cl.

CPC ..... *H01R 13/639* (2013.01); *H01R 13/506* (2013.01); *H01R 13/5205* (2013.01); *H01R 13/629* (2013.01)

(58) Field of Classification Search

CPC .... H01R 12/88; H01R 13/506; H01R 13/514; H01R 13/516; H01R 13/627; H01R 13/6275; H01R 13/629; H01R 13/639; H01R 13/5205

See application file for complete search history.

(56) References Cited

U.S. PATENT DOCUMENTS

| | | | | |
|---|---|---|---|---|
| 4,062,616 | A * | 12/1977 | Shaffer | H01R 12/675 439/399 |
| 4,713,023 | A * | 12/1987 | Bixler | H01R 13/65912 439/393 |
| 5,895,291 | A * | 4/1999 | Furio | H01R 13/65912 439/607.41 |
| 6,932,641 | B1 * | 8/2005 | Liao | H01R 13/58 439/418 |
| 8,545,257 | B2 * | 10/2013 | Pedruzzi | H01R 13/5829 439/470 |
| 10,109,961 | B1 | 10/2018 | Lin | |
| 2009/0215306 | A1 * | 8/2009 | Hanks | H01R 4/5083 439/427 |
| 2010/0105235 | A1 * | 4/2010 | Friedrich | H01R 13/622 439/321 |
| 2014/0305700 | A1 | 10/2014 | Mattson | |
| 2019/0229438 | A1 * | 7/2019 | Naganuma | H01R 13/506 |
| 2021/0242623 | A1 | 8/2021 | Patel | |

FOREIGN PATENT DOCUMENTS

| | | | |
|---|---|---|---|
| CN | 109643867 | A | 4/2019 |

OTHER PUBLICATIONS

European Search Report and Written Opinion for European Application No. EP22190510, dated Jan. 9, 2023, 14 pages.

* cited by examiner

*Primary Examiner* — Oscar C Jimenez
(74) *Attorney, Agent, or Firm* — KDW Firm PLLC

(57) ABSTRACT

Provided herein is are quick-assembly plug connectors. In some embodiments, an assembly may include a body, and a contact carrier within the body, the contact carrier including a main body including a plurality of openings each operable to receive a contact, and a plurality of legs extending from the main body, each of the plurality of legs coupled with the body.

10 Claims, 8 Drawing Sheets

QUICK ASSEMBLY PLUG CONNECTOR

FIELD OF THE DISCLOSURE

The disclosure relates generally to the field of plug connectors and, more particularly, to a quick-assembly plug connector.

BACKGROUND OF THE DISCLOSURE

Electronic braking systems conforming to ISO/DIN 7638, electrical connection of equipment and running gear conforming to ISO 12098, and electrical connection of electronically monitored charging systems conforming to ISO 25981, are all requirements on vehicles weighing over a certain weight limit (e.g., 3.5 tons). In the commercial vehicle sector, these systems include connectors used for the electrical connection between a truck and a trailer/semi-trailer, both for 24V and 12V electrical systems. The connectors are available in 5, 7, or 15 pole versions, and may be equipped with stainless steel locking lever and rollers to prevent accidental disconnection. However, current connectors are overly complex, leading to increased part costs and assembly time.

Accordingly, there is a need for a simplified connector that solves at least the above drawbacks of the prior art.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

In one approach according to the present disclosure, an assembly may include a body, and a contact carrier within the body, the contact carrier including a main body including a plurality of openings each operable to receive a contact, and a plurality of legs extending from the main body, each of the plurality of legs coupled with the body.

In another approach of the disclosure, a plug connector may include a body including a first end, a second end, and an interior cavity. The plug connector may further include a contact carrier within the interior cavity of the body, the contact carrier including a main body including a plurality of openings each operable to receive a contact, and a plurality of legs extending from the main body, each of the plurality of legs coupled with the body.

In yet another approach of the present disclosure, a plug connector may include a body having a first end, a second end, and an interior cavity, and a contact carrier within the interior cavity of the body. The contact carrier may include a main body including a plurality of openings each operable to receive a contact, and a plurality of legs extending from the main body. Each of the plurality of legs may be coupled with the body, wherein the plurality of legs are configurable between an open position wherein a central support of the plurality of legs is disengaged from a cable connected with the contact, and a closed position wherein the central support of the plurality of legs is engaged with the cable.

BRIEF DESCRIPTION OF THE DRAWINGS

The accompanying drawings illustrate exemplary approaches of the disclosed embodiments so far devised for the practical application of the principles thereof, and in which.

Figure 1:
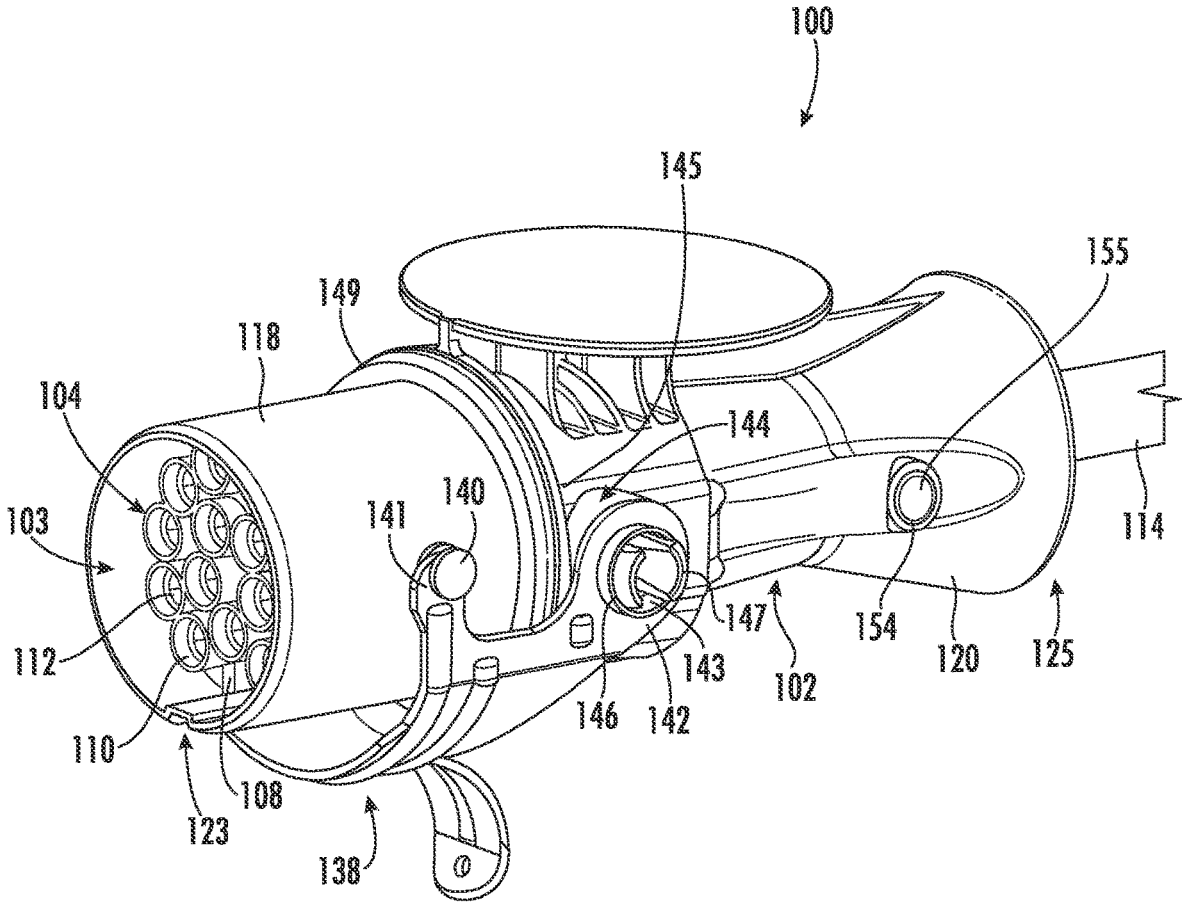
FIG. 1 depicts a first perspective view of a plug connector according to embodiments of the present disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

Embodiments in accordance with the present disclosure will now be described more fully hereinafter with reference to the accompanying drawings. The assemblies, components thereof, and methods may be embodied in many different forms and should not be construed as being limited to the embodiments set forth herein. Rather, these embodiments are provided so that this disclosure will be thorough and complete, and will fully convey the scope of the assemblies, components, and methods to those skilled in the art.

Figure 2:
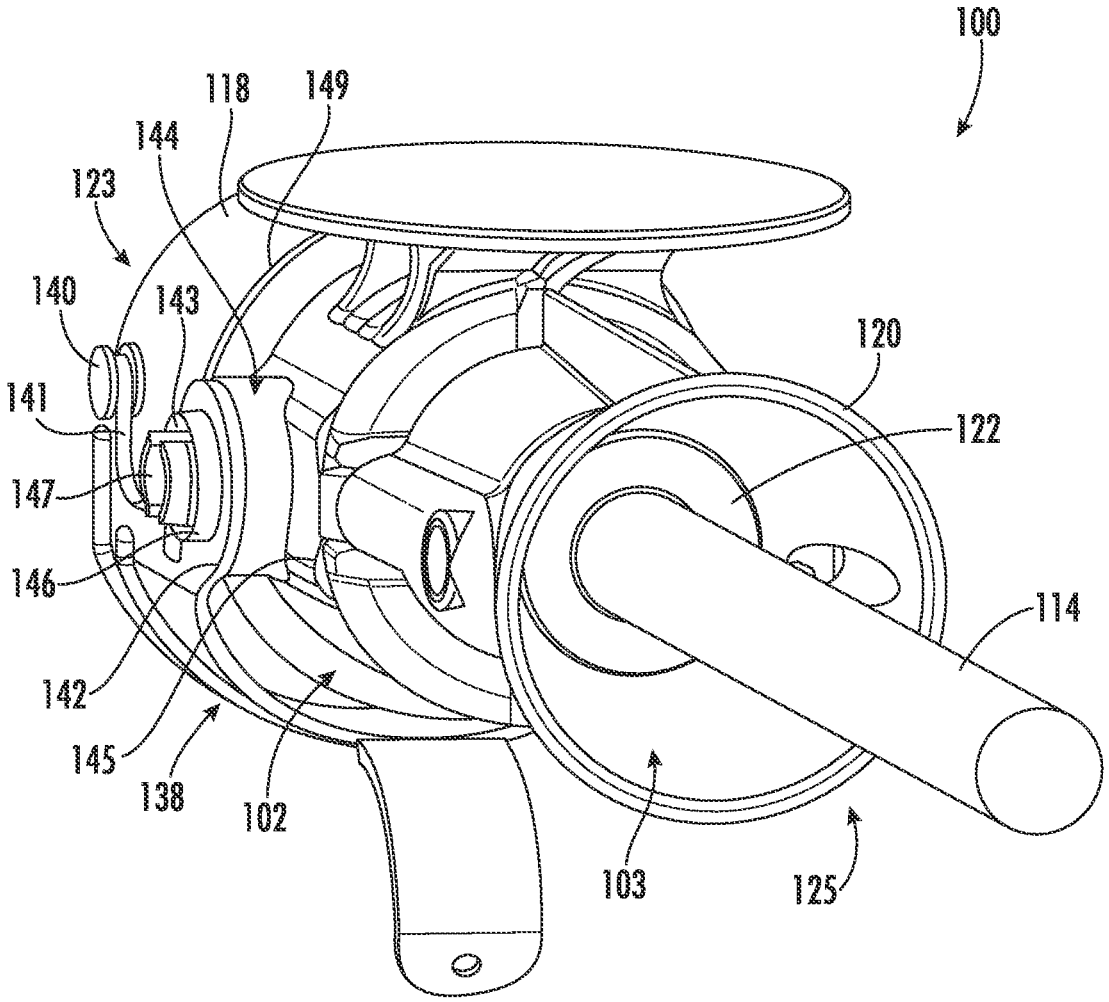
FIG. 2 depicts a second perspective view of the plug connector according to embodiments of the present disclosure.
Figure 3:
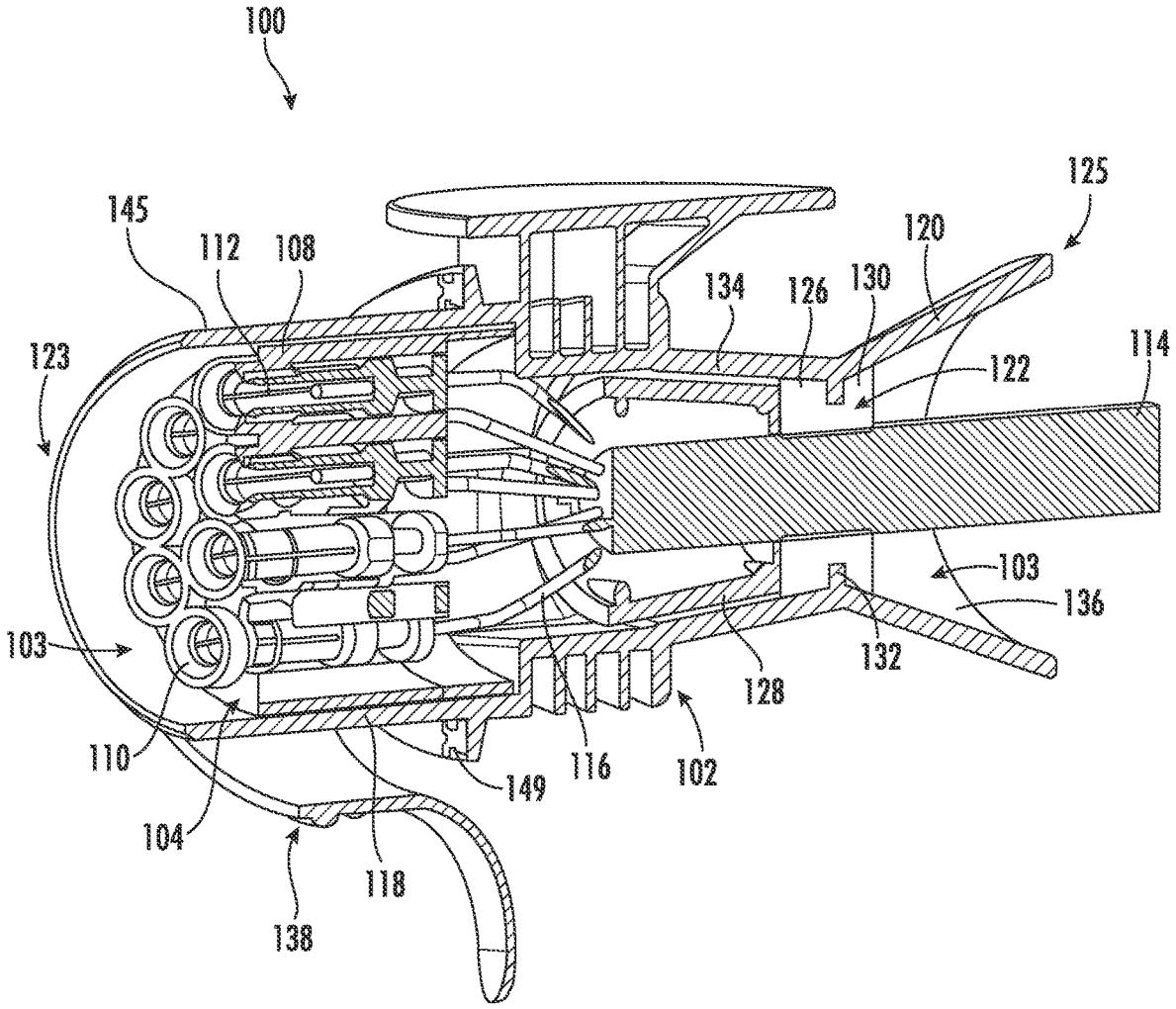
FIG. 3 depicts a cross-sectional view of the plug connector according to embodiments of the present disclosure.

FIGS. 1-3 illustrate a plug connector (hereinafter "connector") 100 according to embodiments of the present disclosure. The connector 100 may include a body 102 and a contact carrier 104 within an internal cavity 103 of the body 102. As will be described in greater detail herein, the contact carrier 104 may include a main body 108 including a plurality of openings 110 each operable to receive an electrical contact 112. The contacts 112 may be connected to a cable 114 by a series of connections (e.g., wires or leads) 116 (FIG. 3). The connections 116 may be fixed to the contacts 112 by contact screws or by crimping.

The body 102 may include a first section 118 at a distal end 123 and a second section 120 at a proximal end 125. The first section 118 may define a first portion of the internal cavity 103, wherein the first portion is operable to receive the main body 108 of the contact carrier 104 and the contacts 112. The second section 120 of the body 102 may extend from the first section 118, the second section 120 defining a second portion of the internal cavity 103. In some embodiments, the second section 120 may take on a bell or trumpet-shape configuration. Although non-limiting, the body 102 may be made from one or more non-conductive materials.

In some embodiments, the second section 120 may include a gasket 122 within the second portion of the internal cavity 103. The gasket 122 is operable to surround and protect the cable 114. As best shown in FIG. 3, in some embodiments, the gasket 122 may include a first portion 126 adjacent to, or in abutment with, a central support 128 of the contact carrier 104. The gasket 122 may include a second portion 130 connected with the first portion 126, wherein the second portion 130 may extend within the internal cavity 103 of the second section 120 of the body 102. The first portion 126 of the gasket 122 may form a seal against an interior surface 134 of the body 102 adjacent the central support 128, and the second portion 130 of the gasket 122 may form a seal against a second interior surface 136 of the second section 120 of the body 102. As further shown, the gasket 122 may further include a recess operable to engage a ridge or flange 132 along the interior surface 134 of the body 102 to maintain positioning of the gasket 122 within the body 102.

As further shown, the connector 100 may include a locking device 138 coupled to the body 102. In some embodiments, the locking device 138 may include one or more rollers 140 adjacent the first section 118 of the body 102, wherein the rollers 140 may be pushed through an opening of a first arm 141. Each roller 140 may have a central area with a reduced diameter to accommodate the first arm 141. The first arm 141 and the opening through the first arm 141 may be bent or stretched to receive the roller 140. The rollers 140 ensure mechanical engagement between the locking device 138 and a socket (not shown). Unlike prior art approaches, which require rivets in addition to rollers and the locking device, the present embodiments include just two rollers and a single locking device, which simplifies assembly and reduces overall cost.

A second arm 142 of the locking device 138 may include an opening 143 operable to receive a snap-fit joint 144 along an exterior 145 of the body 102. Although non-limiting, the snap-fit joint 144 may include one or more flexible arms or tabs 147 operable to engage a flange 146 surrounding the opening 143 to maintain a connection between the second arm 142 and the body 102. As further shown, the connector 100 may include a sealing ring 149 mounted around the first section 118 of the body 102 to create a seal between the body 102 and a second coupled connector body (not shown).

Figure 4:
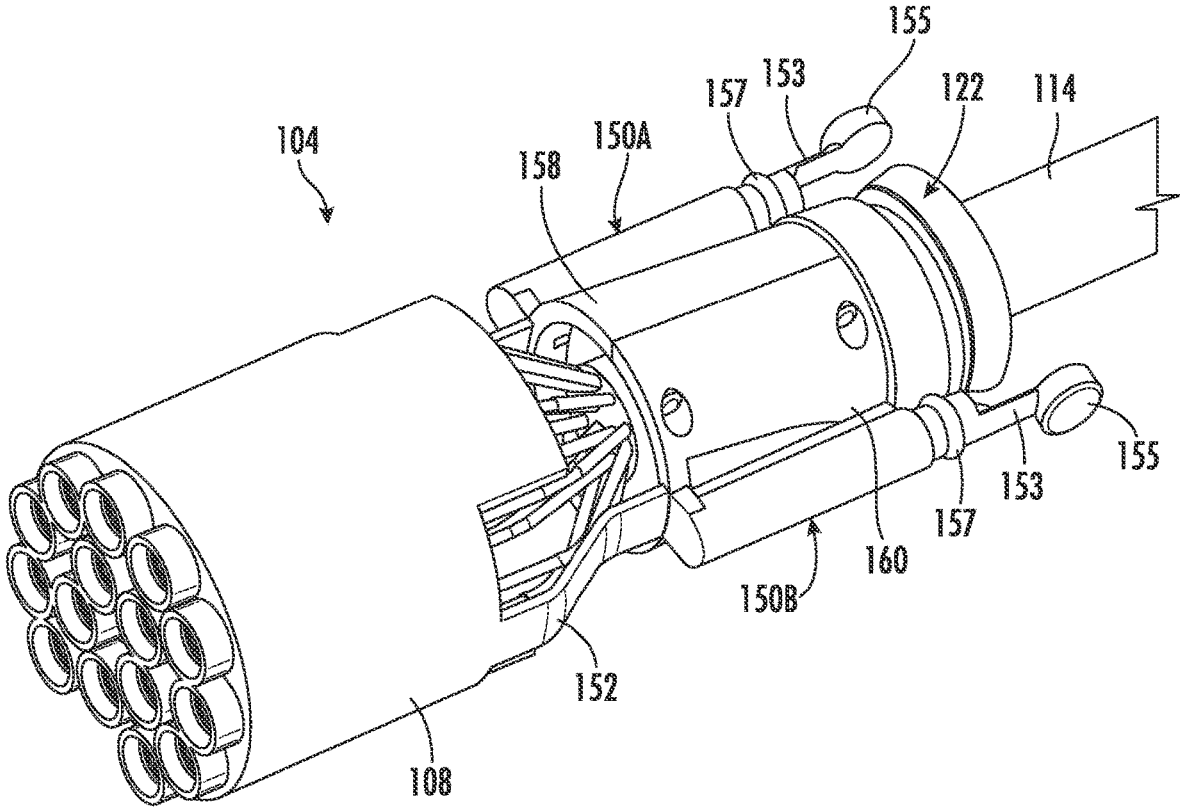
FIG. 4 depicts a perspective view of a contact carrier of the plug connector according to embodiments of the present disclosure.

Turning to FIG. 4, the contact carrier 104 according to embodiments of the present disclosure will be described in greater detail. As shown, the contact carrier 104 may include first and second legs 150A, 150B extending from the main body 108. Each of the first and second legs 150A, 150B may be include a base 152 connected to, or integrally formed with, the main body 108, and a free end 153 opposite the base 152. The free end 153 may include a depressible tab or button 155, which extends through an opening 154 (FIG. 1) of the second section 120 of the body 102. The buttons 155 may permit the contact carrier 104 to be conveniently released from the body 102. In some embodiments, the free ends 153 may include a sealing ring 157 operable to prevent moisture from entering the internal cavity 103 via the opening 154 of the body 102.

As further shown, the contact carrier 104 may include the central support 128 surrounding the cable 114. Although not limited to any particular configuration, the central support 128 may include a first component 158 coupled with a second component 160. Together, the first and second components 158, 160 may define a central cavity operable to receive and lock the cable 114 therein. In some embodiments, the first and second components 158, 160 may be located between the base 152 and the free ends 153 of the first and second legs 150A-150B, respectively.

Figure 5A:
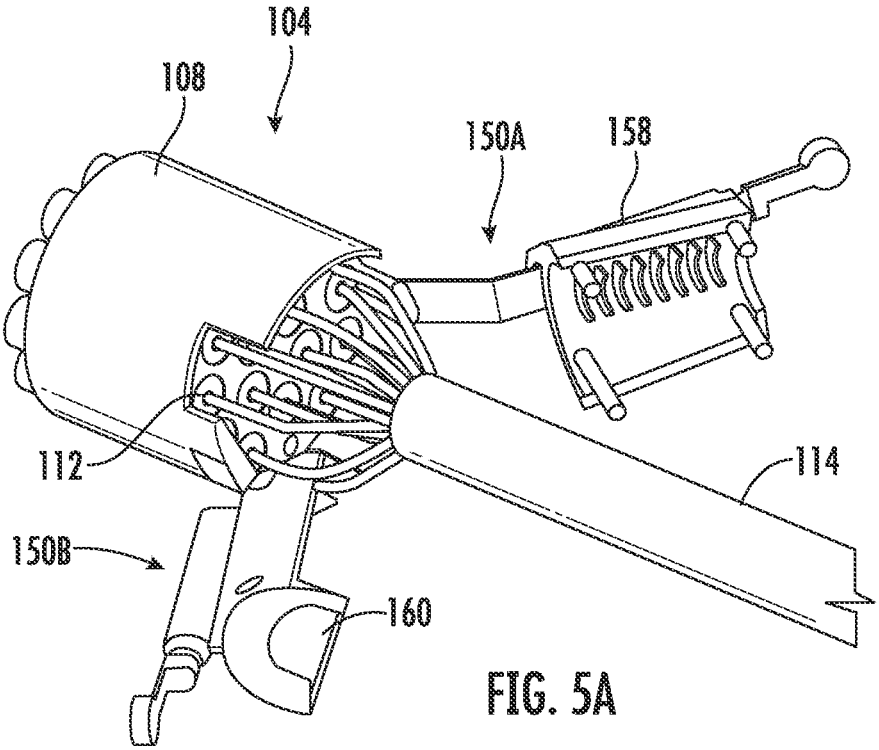
FIGS. 5A-5B depict perspective views of the contact carrier of the plug connector according to embodiments of the present disclosure.
Figure 5B:
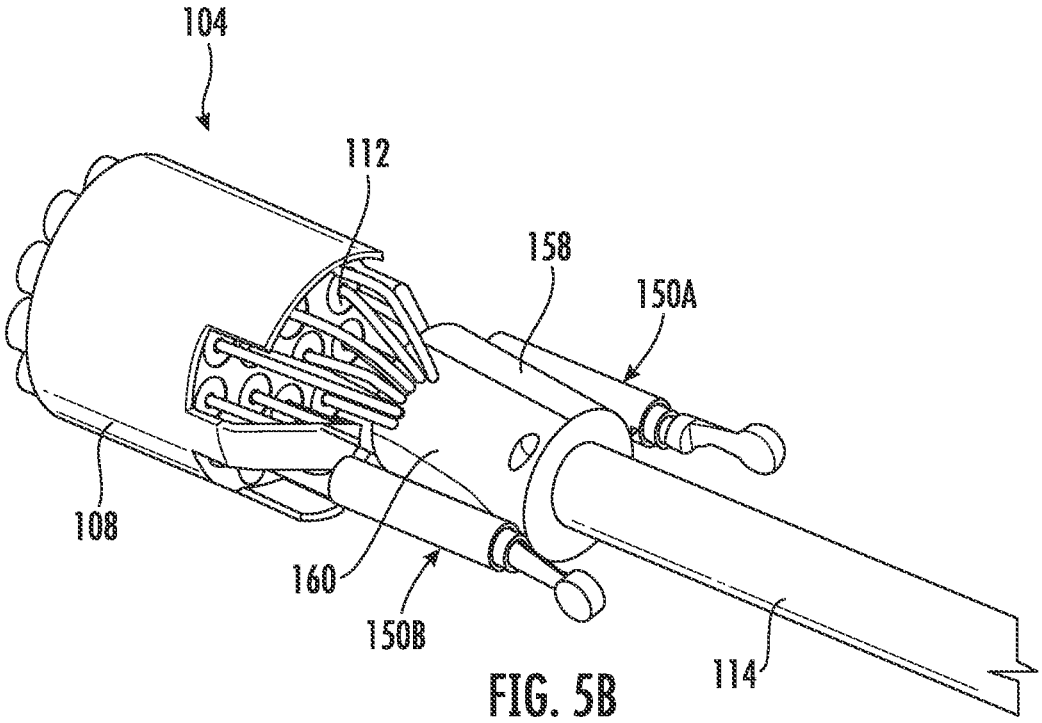

During use, the first and second components 158, 160 may move between an open position (FIG. 5A), in which the first and second components 158, 160 are disengaged from one another and rotated/bent away from the cable 114, and a closed position (FIG. 5B), in which the first and second components 158, 160 are brought towards one another and coupled together, e.g., by one or more fasteners. This configuration allows easier and quicker assembly/disassembly between the contact carrier 104 and the contacts 112.

Figure 6A:
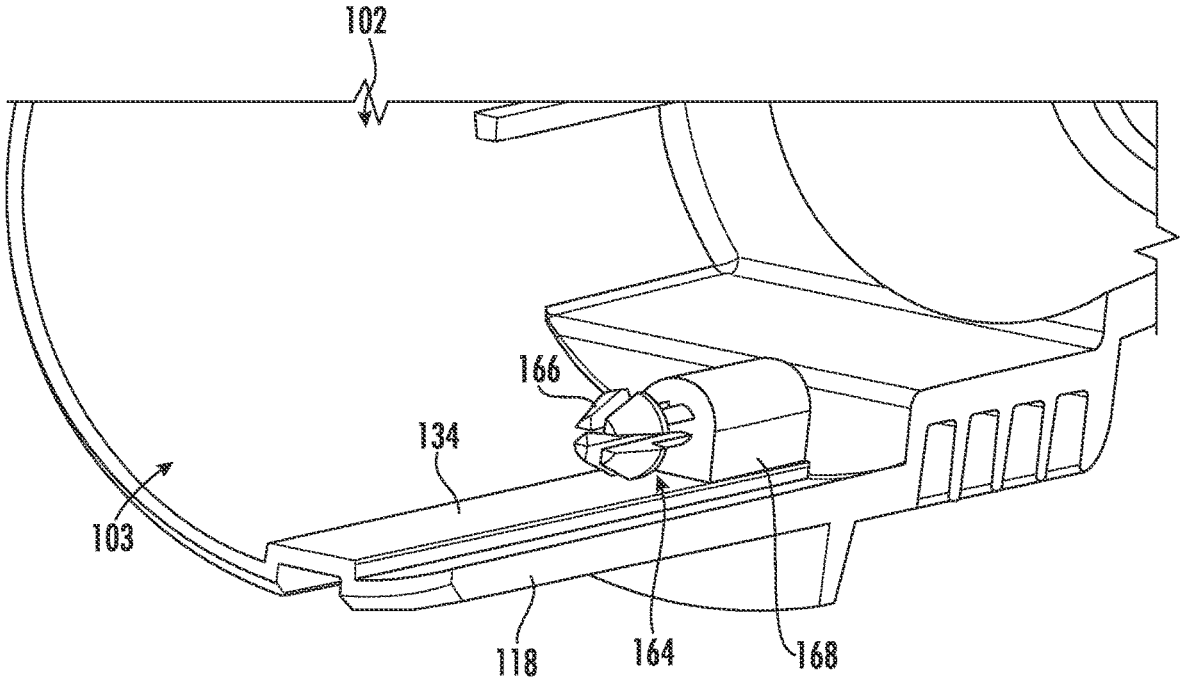
FIG. 6A is a cross-sectional perspective view of a body of the plug connector according to embodiments of the present disclosure.
Figure 6B:
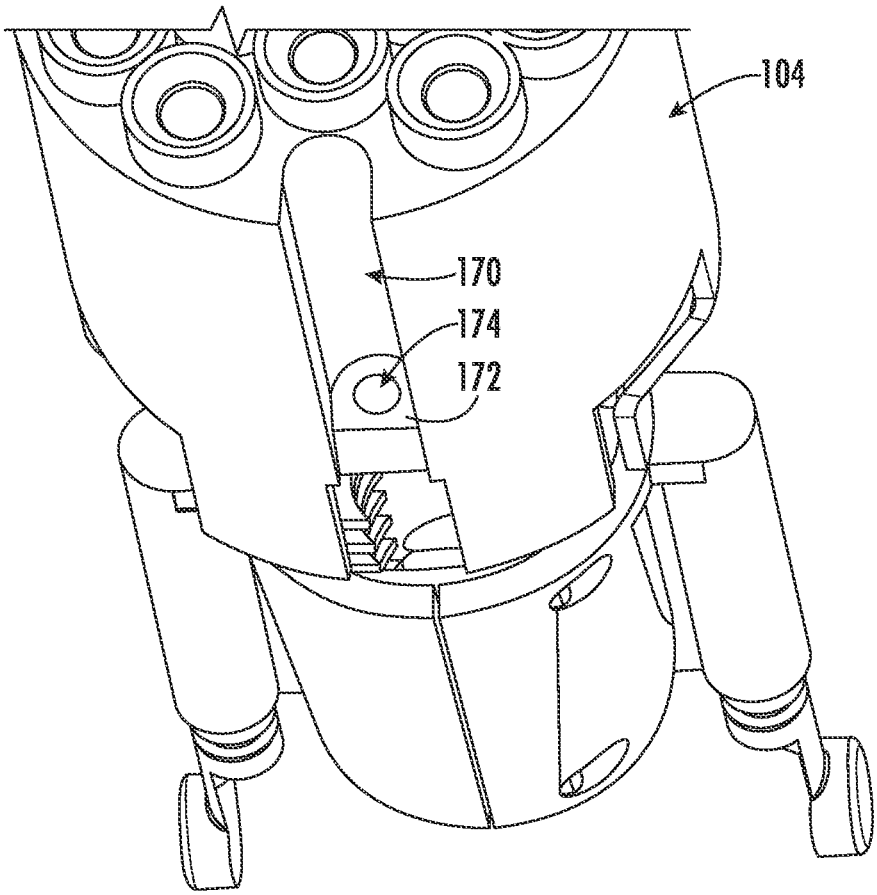
FIG. 6B is a perspective view of an underside of the contact carrier of the plug connector according to embodiments of the present disclosure.
Figure 6C:
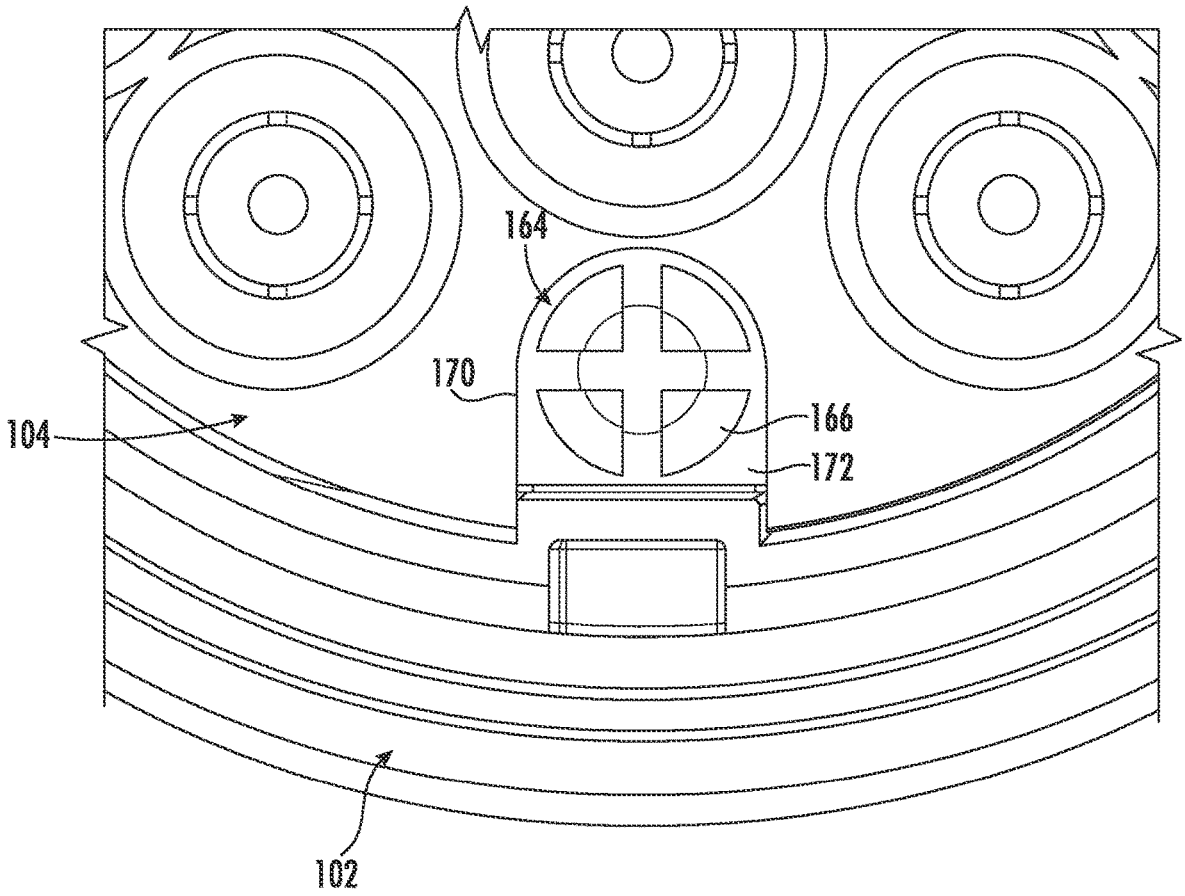
FIG. 6C is a front view of a coupling between the contact carrier and the body of the plug connector according to embodiments of the present disclosure.

Turning now to FIGS. 6A-6C, an approach for coupling together the body 102 and the contact carrier 104 will be described. As shown in FIG. 6A, the body 102 may include a snap-fit joint or device 164 within the internal cavity 103 of the first section 118 of the body 102. In some embodiments, the snap-fit device 164 may be a circular snap-fit joint including a plurality of flexible arms or tabs 166 separated from one another by one or more gaps. The flexible tabs 166 may extend from a base 168 extending into the internal cavity 103 from the interior 134 of the body 102.

As shown in FIGS. 6B-6C, the contact carrier 104 may include a channel 170 and a retaining wall 172 extending across the channel 170. The retaining wall 172 may include an opening 174 operable to receive the flexible tabs 166 of the snap-fit device 164. With the snap-fit device 164 engaged with the retaining wall 172, mechanical retention of the contact carrier 104 within the body 102 is improved.

The foregoing discussion has been presented for purposes of illustration and description and is not intended to limit the disclosure to the form or forms disclosed herein. For example, various features of the disclosure may be grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other.

Furthermore, identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes. Thus, the claims set forth below are to be construed in view of the full breadth and spirit of the present disclosure as described herein.

What is claimed is:

1. An assembly, comprising: a body comprising a first section including a first cavity operable to receive a main body of a contact carrier; and a second section including a second cavity operable to receive a plurality of legs of the contact carrier; the contact carrier comprising: a main body including a plurality of openings each operable to receive a contact; the plurality of legs extending from the main body, each of the plurality of legs coupled with the body, wherein the plurality of legs are rotatable between an open position and a closed position, wherein in the closed position the plurality of the legs extend parallel to one another, and wherein in the open position the plurality of legs are angled away from one another; wherein each of the plurality of legs includes a central support operable to engage the cable; wherein the plurality of legs comprises a flexible first leg and a flexible second leg, and wherein the central support of the flexible first leg is coupleable with the central support of the flexible second leg; wherein the first and second flexible legs each comprises a button at a free end, and wherein the button extends through the second section of the body; and a gasket within the second cavity of the second section of the body, wherein the gasket is operable to engage a cable connected to the contacts.

2. The assembly of claim 1, further comprising a locking device coupled to the body, the locking device including an opening operable to receive a snap-fit joint along an exterior of the body.

3. The assembly of claim 2, wherein the locking device comprises a roller extending through an opening of a first arm.

4. The assembly of claim 1, wherein the body and the contact carrier are coupled together, and wherein the contact carrier comprises an opening operable to receive a snap-fit joint along an interior of the body.

5. A plug connector, comprising: a body including a first end, a second end, an interior cavity, a first section at the first end, the first section operable to receive a main body of a contact carrier, and a second section at the second end; a contact carrier within the interior cavity of the body, the contact carrier comprising: a main body including a plurality of openings each operable to receive a contact; and a plurality of legs extending from the main body, each of the plurality of legs coupled with the body, wherein the second section of the body is operable to receive the plurality of legs; and a gasket within the second section of the body, wherein the gasket is operable to engage a cable connected to the contacts, wherein each of the plurality of legs includes a central support operable to engage the cable; wherein the plurality of legs comprises a flexible first leg and a flexible second leg, and wherein the central support comprises: a first component between a first base and a first free end of the first flexible leg; and a second component between a second base and a second free end of the second flexible leg, wherein when the first component and the second component are coupled together, the central support is in a closed position about the cable, and wherein when the first component and the second component are disengaged from one another, the central support is in an open position away from the cable; wherein the plurality of legs are rotatable between the open position and the closed position, wherein in the closed position the plurality of the legs extend parallel to one another, and wherein in the open position the plurality of legs are angled away from one another.

6. The plug connector of claim 5, wherein the first and second flexible legs each comprises a button at a free end, wherein the button extends through the second section of the body, and wherein each of the first and second flexible legs includes a sealing ring along an exterior surface.

7. The plug connector of claim 5, further comprising a locking device coupled to the body, the locking device including an opening operable to receive a snap-fit joint extending from an exterior of the body.

8. The plug connector of claim 5, wherein the body and the contact carrier are coupled together, and wherein the contact carrier comprises an opening operable to receive a snap-fit joint along an interior of the body.

9. A plug connector, comprising:

a body including a first end, a second end, and an interior cavity;

a contact carrier within the interior cavity of the body, the contact carrier comprising:

a main body including a plurality of openings each operable to receive a contact; and a plurality of legs extending from the main body, wherein each of the plurality of legs is rotatably coupled with the body, wherein the plurality of legs are rotatable between an open position and a closed position, wherein in the closed position the plurality of the legs extend parallel to one another, wherein in the open position the plurality of legs are angled away from one another, in the open position a central support of the plurality of legs is disengaged from a cable connected with the contact, and wherein in the closed position the central support of the plurality of legs is engaged with the cable;

wherein the plurality of legs comprises a flexible first leg and a flexible second leg, wherein the central support comprises:

a first component between a first base and a first free end of the first flexible leg; and a second component between a second base and a second free end of the second flexible leg, wherein when the first component and the second component are coupled together the central support is in the closed position, and wherein when the first component and the second component are disengaged from one another the central support is in the open position.

10. The plug connector of claim 9, wherein the body comprises:

a first section at the first end, the first section operable to receive the main body of the contact carrier; and a second section at the second end, the second section operable to receive the plurality of legs of the contact carrier, wherein the cable is extendable through the second section, and wherein a gasket is positioned within the second section and surrounding the cable.

* * * * *